US006283840B1

(12) United States Patent
Huey

(10) Patent No.: US 6,283,840 B1
(45) Date of Patent: Sep. 4, 2001

(54) CLEANING AND SLURRY DISTRIBUTION SYSTEM ASSEMBLY FOR USE IN CHEMICAL MECHANICAL POLISHING APPARATUS

(75) Inventor: Sidney Huey, Oakland, CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 09/366,382

(22) Filed: Aug. 3, 1999

(51) Int. Cl.[7] ..... B24B 29/00
(52) U.S. Cl. ..... 451/288; 451/56
(58) Field of Search ..... 451/56, 444, 443, 451/446, 288, 60

(56) References Cited

U.S. PATENT DOCUMENTS

| | | | | |
|---|---|---|---|---|
| 5,299,393 | | 4/1994 | Chandler et al. | 51/272 |
| 5,320,706 | | 6/1994 | Blackwell | 156/636 |
| 5,421,768 | * | 6/1995 | Fujiwara et al. | 451/283 |
| 5,456,627 | | 10/1995 | Jackson et al. | 451/11 |
| 5,486,131 | * | 1/1996 | Cesna et al. | 451/56 |
| 5,578,529 | * | 11/1996 | Mullins | 437/228 |
| 5,611,943 | * | 3/1997 | Cadien et al. | 216/88 |
| 5,616,069 | * | 4/1997 | Walker et al. | 451/56 |
| 5,645,682 | * | 7/1997 | Skrovan | 156/636.1 |
| 5,664,990 | | 9/1997 | Adams et al. | 451/60 |
| 5,665,201 | | 9/1997 | Sahota | 438/693 |
| 5,683,289 | | 11/1997 | Hempel, Jr. | 451/56 |
| 5,690,544 | | 11/1997 | Sakurai | 451/444 |
| 5,709,593 | | 1/1998 | Guthrie et al. | 451/287 |
| 5,716,264 | * | 2/1998 | Kimura et al. | 451/443 |
| 5,938,507 | | 8/1999 | Ko et al. | 451/56 |
| 6,053,801 | * | 4/2000 | Pinson et al. | 451/56 |
| 6,139,406 | | 10/2000 | Kennedy, et al. | 451/67 |

* cited by examiner

*Primary Examiner*—Joseph J. Hail, III
*Assistant Examiner*—David B. Thomas
(74) *Attorney, Agent, or Firm*—Fish & Richardson

(57) ABSTRACT

A cleaning and slurry distribution assembly for use in a chemical mechanical polishing apparatus. The cleaning assembly includes a plurality of nozzles for directing a cleaning fluid against a polishing pad. The cleaning assembly further includes a housing for containing residual droplets, slurry and contaminants. The slurry distribution assembly includes a ring for optimally distributing slurry on the polishing pad.

18 Claims, 5 Drawing Sheets

CLEANING AND SLURRY DISTRIBUTION SYSTEM ASSEMBLY FOR USE IN CHEMICAL MECHANICAL POLISHING APPARATUS

BACKGROUND

The invention relates chemical mechanical polishing of substrates, and more particularly to dispensing slurry onto a polishing pad and cleaning the polishing pad.

Chemical mechanical polishing (CMP) is a process by which a substrate surface is planarized to a uniform level. In a conventional CMP apparatus, substrate is mounted on a rotatable carrier head and pressed against a rotating polishing pad. An abrasive chemical solution (slurry) is applied onto the polishing pad to aid in the polishing of the substrate to achieve a desired surface finish. Over time, the polishing process glazes the polishing pad and creates irregularities in the polishing pad surface that can adversely affect the substrate surface finish. The polishing pad surface is typically "conditioned" by scouring the polishing pad surface with an abrasive device known as a conditioning disk to deglaze and roughen the polishing pad surface. Periodically conditioning the pad maintains the pad surface at a consistent state of roughness to achieve consistent polishing uniformity.

One problem encountered in CMP is the generation of contaminants on the polishing pad surface during the polishing and conditioning procedures. These contaminants have a material adverse affect on the polishing process. For example, contaminants include (but are not limited to) abraded polishing pad material, dried slurry particles, conditioning disk material and airborne contaminants. Adverse material effects include (but are not limited to) scratching of the substrate and embedding of the particles in the polishing pad or substrate. It would be advantageous if the polishing apparatus cleaned the polishing pad to provide a substantially contaminant-free polishing pad.

Another problem in CMP is that slurry is an expensive consumable. A CMP system may use more than two hundred milliliters of slurry per minute. In general, the substrate takes two to three minutes to polish. Thus, a CMP system can use up to a sixth of a gallon of slurry per substrate. The per substrate cost of CMP could be reduced considerably by reducing the amount of slurry used. In addition, where excessive slurry is applied, the substrate can hydroplane over the surface of the polishing pad, thereby reducing the polishing rate. It would be advantageous if the CMP apparatus that reduced slurry consumption in the polishing process.

SUMMARY

In one aspect, the invention is directed to an apparatus for use in a chemical mechanical polishing system. The apparatus has a housing positionable over a polishing pad and at least one nozzle covered by the housing to spray a cleaning fluid against the polishing pad.

Implementations of the invention may include the following. The cleaning fluid may be deionized water, and may be sprayed by the nozzle under hydraulic pressure. The housing may extends toward the center of the polishing pad, and may be configured to be raised and lowered over a region of the polishing pad. A retainer may be joined to a lower surface of the housing, and may contact a surface of the polishing pad, e.g., at a pressure less than about 5 psi. A first feed line may supply the cleaning fluid to the assembly, a second feed line may supply a solution of deionized water and an agent selected from the group consisting of a corrosion inhibitor, a cleaner, an oxidizer, a pH adjustor, a dilution fluid, and a surface wetting agent, and a third feed line may supply an abrasive solution.

In another aspect, the invention is directed to a method of cleaning the surface of a polishing pad in a chemical mechanical polishing system. A cleaning fluid is directed from a cleaning assembly against a polishing pad that has residual contaminants, and the cleaning fluid is substantially contained within a housing of the cleaning assembly.

Implementations of the invention may include the following features. The cleaning fluid may be deionized water, and droplets of the cleaning fluid may be produced by subjecting the deionized water to a hydraulic pressure, e.g., of less than about 60 psi, such as less than about 10 psi.

In another aspect, the invention is directed to an apparatus for distributing slurry onto a polishing surface. The apparatus has a retainer having a lower surface in close proximity to the polishing surface and enclosing a region, and an outlet to distribute slurry to the enclosed region to form a reservoir of slurry in the enclosed region. The slurry is distributed to a region not enclosed by the retainer by traveling between the polishing surface and the lower surface of the retainer.

In another aspect, the invention is directed to a method of preparing the surface of a polishing pad in a chemical mechanical polishing system for polishing a substrate. In the method, a cleaning fluid impinges against the polishing pad having at least one of residual polishing slurry, contaminants and fluid. the cleaning fluid, residual polishing slurry, contaminants and fluid are substantially contained by means of a housing. The housing is lifted to expel at least a portion of the residual polishing slurry, contaminants and fluid from the polishing pad. A polishing slurry is applied to the polishing pad, and the polishing slurry is spread over the polishing pad with a lower surface of the housing.

The present invention advantageously cleans the polishing pad to provide a substantially contaminant-free polishing pad. The invention also can apply a uniform layer of polishing slurry to the polishing pad to provide improved polishing and planarization of the substrate while minimizing/optimizing the amount of slurry used.

Other features and advantages will become apparent from the following description, including the drawings and the claims.

DETAILED DESCRIPTION

Figure 1:
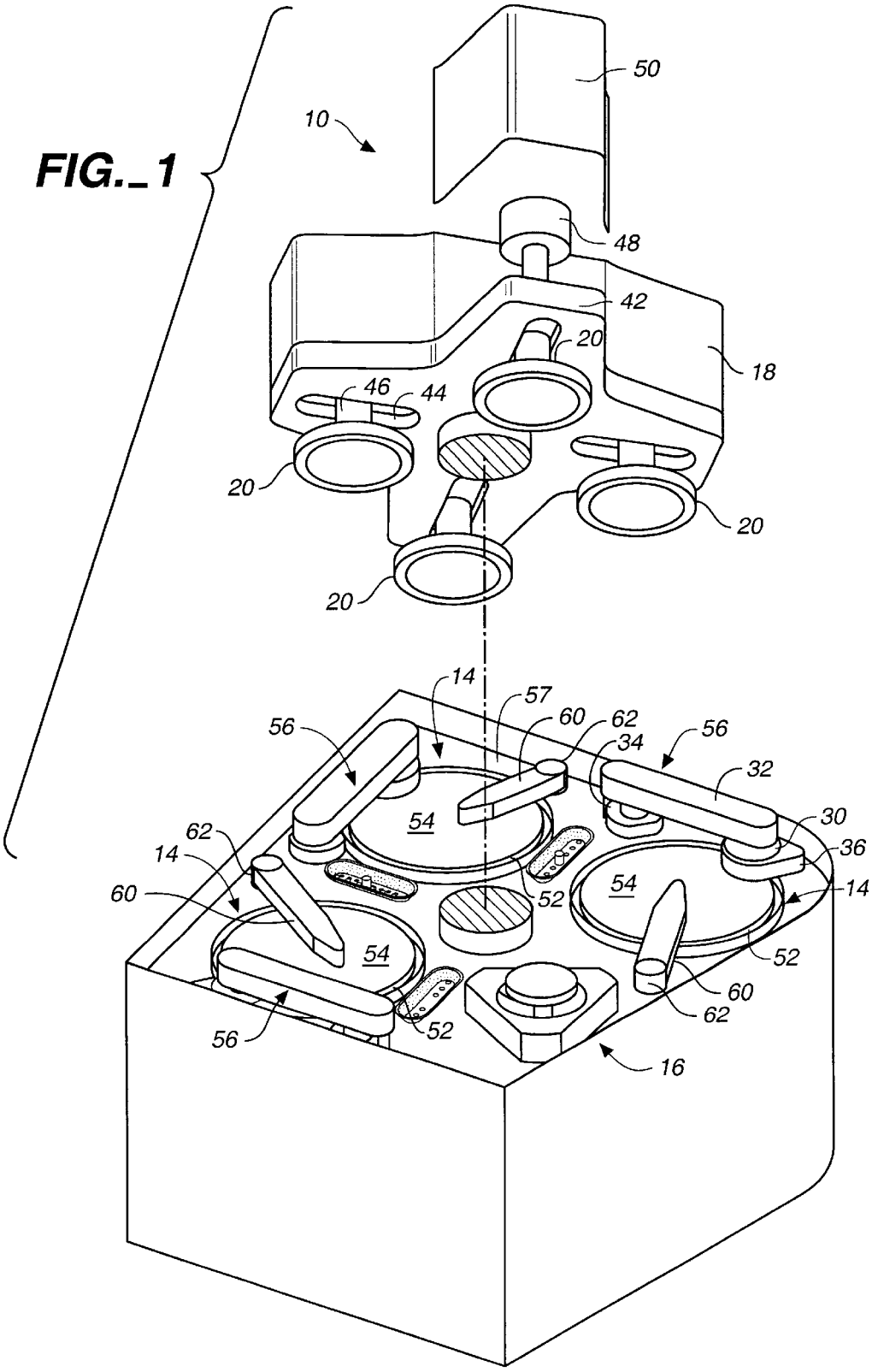
FIG. 1 is a schematic exploded view of a chemical mechanical polishing system.

Referring to FIG. 1, a chemical mechanical polishing apparatus 10 includes three independently-operated polishing stations 14, a substrate transfer station 16, and a rotatable carousel 18 which choreographs the operation of four independently rotatable carrier heads 20. A similar polishing apparatus is discussed in U.S. Pat. No. 5,738,574, the entirety of which is incorporated herein by reference.

The carousel 18 has a support plate 42 with slots 44 through which drive shafts 46 for the carrier heads 20 extend. The carrier heads 20 independently rotate and oscillate back-and-forth in the slots 44. The carrier heads 20 are rotated by the respective motors 48, which are normally hidden behind removable sidewalls 50 of the carousel 18. In operation, a substrate is transferred from the transfer station 16 to a carrier head 20. The carousel 18 then transfers the carrier head and substrate through a series of one or more polishing stations 14, and finally returns the substrate to the transfer station 16.

Each polishing station 14 includes a rotatable platen 52 having secured thereto a polishing pad 54. The polishing station 14 optionally includes a pad conditioner 56 mounted to a tabletop 57 of the polishing apparatus 10. Each pad conditioner 56 includes a conditioner head 30, an arm 32, and a base 34 for positioning the conditioner head 30 over the surface of the polishing pad to be conditioned. Each polishing station 14 also includes a cup 36 containing a fluid for rinsing the conditioner head 30.

Figure 2:
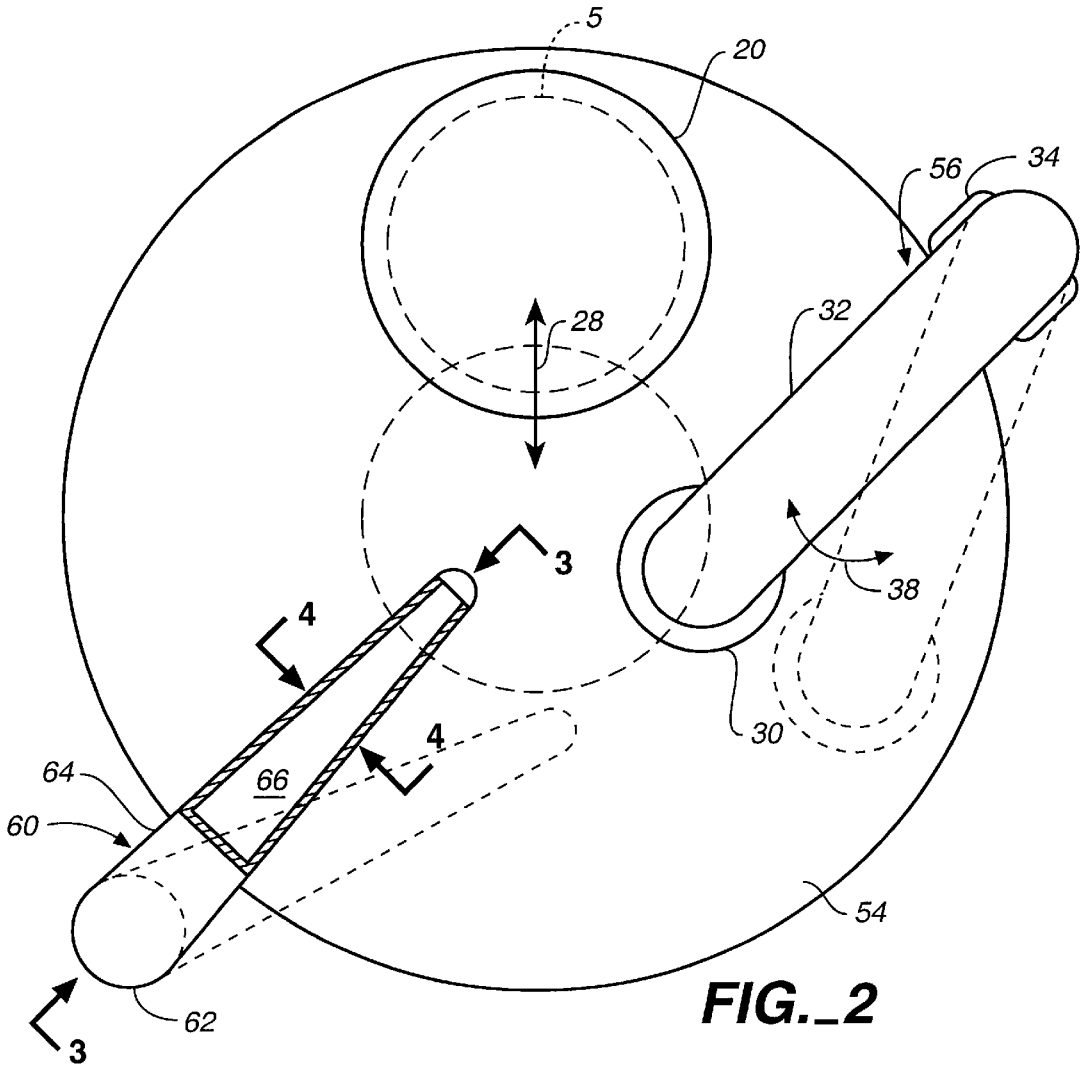
FIG. 2 is a schematic top view of the CMP system of FIG. 1 showing a carrier head, a conditioning apparatus, and a cleaning and slurry distribution arm assembly.

Referring to FIG. 2, the polishing pad 54 is conditioned by the pad conditioner 56 while the polishing pad 54 polishes a substrate 5 (shown in phantom) mounted on the carrier head 20. The conditioner head 30 sweeps across the polishing pad 54 with a motion that is synchronized with the motion of the carrier head 20 to avoid collision. Such synchronization may be controlled, for example, by a general purpose computer. For example, the carrier head 20 may be positioned in the center of the polishing pad 54 and the conditioner head 30 may be immersed in a rinsing fluid contained within the cup 36. During polishing, the cup 36 may pivot out of the way, and the carrier head 20 and the conditioner head 30 may be swept back-and-forth across the polishing pad 54 (e.g., between the positions shown in solid and phantom) as shown by arrows 28 and 38, respectively.

Each polishing station 14 also includes a corresponding slurry delivery and cleaning arm assembly 60 mounted to the table top 57 by a support post 62. The arm assembly 60 serves two main purposes: to spread slurry over the surface of the pad in a thin layer, and to remove residues and contaminants, such as residual slurry, dirt, dust, abraded substrate material, abraded polishing pad material and other contaminants that would have a material adverse affect on the polishing process, from the polishing pad surface. The arm assembly 60 extends over the polishing pad from the pad edge to the pad center. The arm assembly 60 may be designed and configured to pivot about the support post 62 so as to sweep across over the surface of the polishing pad 54. Specifically, the motion of the arm assembly 60 may be synchronized with the motion of the carrier head 20 and the conditioner head 30 to avoid collisions therebetween. Alternately, if the carrier head does not move over the pad center, the arm assembly 60 can remain stationary during polishing.

Figure 3:
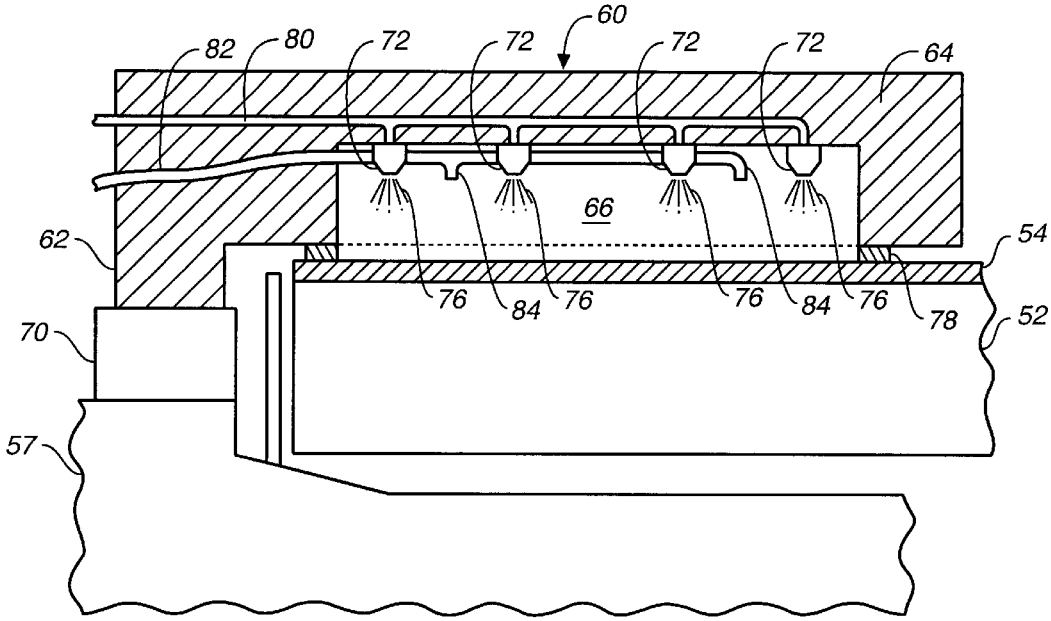
FIG. 3 is a cross-sectional view of the cleaning and slurry distribution assembly of FIG. 2 taken along line 3—3.
Figure 4:
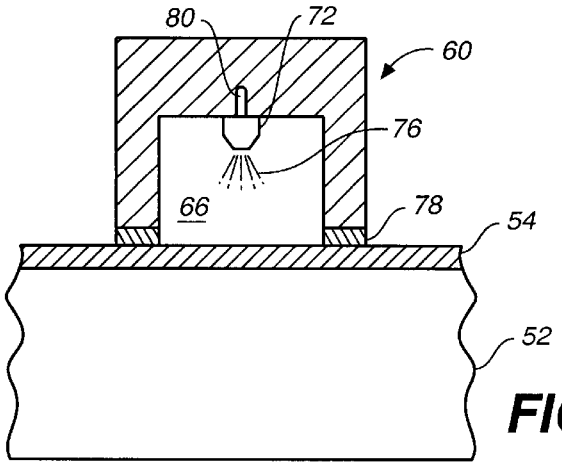
FIG. 4 is a cross-sectional view of the cleaning and slurry distribution assembly of FIG. 2 taken along line 4—4.

As shown in FIGS. 2, 3 and 4, the slurry dispensing/cleaning arm assembly 60 includes an elongated housing 64 that extends from the platen edge to near the platen center. The housing 64 is supported by the support post 62, and has a recess with an opening on the side of the housing that faces the polishing pad 54. The volume between the polishing pad 54 and the housing 64 defines a chamber 66. The chamber 66 contains the streams of cleaning fluid, and serves as a container for the slurry.

To clean the polishing pad, a spray of cleaning fluid is directed from the arm assembly 60 onto the polishing pad surface. Specifically, a set of fluid dispensing nozzles 72 are located inside the chamber 66 to spray streams 76 of a cleaning fluid, such as deionized water, against the top surface of the polishing pad 54. Although four nozzles are illustrated, the assembly 60 could include more or fewer nozzles. The assembly may include 4–6 nozzles. The stream 76 from each nozzle 72 cleans and loosens residues and contaminants (such as residual liquid slurry, dust, dried slurry, abraded polishing pad material, abraded substrate, etc.) from the polishing pad 54, particularly from any grooves or holes in the polishing pad 54. Such cleaning advantageously prepares the polishing pad 54 for polishing. The cleaning fluid is supplied to the nozzles by a feed line 80. Although illustrated as a passage through the housing 64, the feed line 80 could be implemented as tubing inside or outside the chamber 66.

The nozzles 72 may be any conventional nozzle capable of atomizing the cleaning fluid. For example, each nozzle may be an airless nozzle in which the cleaning fluid is forced through a small orifice under hydraulic pressure, such as less than about 60 psi, e.g., about 10–60 psi. The nozzles may also be air-assisted nozzles in which the cleaning fluid is forced through a small orifice under pressure (such as 60 psi) and the resultant fluid stream is further atomized and propelled by a compressed gas, such as compressed air. The compressed air may be pressurized, e.g., up to 10 psi, or about 5 psi. As such, the cleaning liquid may be sprayed at a rate in the range of about 0.2 to 1.0 gal/min. The nozzles 72 may be constructed from a chemical and corrosion resistant material, such as a polyvinyldene fluoride (PVDF) thermoplastic. For example, each nozzle may be a KYNAR4® Series Spray Nozzle, Model HVV-KY.

The assembly also includes a lower retainer 78 that projects downwardly from the housing 64, and can be lowered to contact the polishing pad 54. The housing 64 and the retainer 78 may be a unitary body, or the retainer 78 may be secured (e.g., by an adhesive or by screws or bolts) to the housing 64. When the lower retainer 78 contacts the polishing pad 54, it forms a dam to retain slurry and rinse water within a reservoir formed by the retainer and pad. The lower retainer 78 may contact the pad 54 at pressure of about 1 psi. The retainer 78 and the housing 64 may be constructed from a chemically resistant and wear resistant material, such as a polyphenylsulfide (PPS), a polytetrafluoroethylene (PTFE) or DELRIN™.

The arm assembly 60 is adapted to move up and down (i.e., to be raised and lowered with respect to the polishing pad 54) by a pneumatic or mechanical actuator 70. The arm assembly 60 is lowered in contact with the polishing pad 54 to enclose the streams 76 of deionized water and prevent the resulting waste materials (e.g., polishing slurry, residues, contaminants, waste water, etc.) from splashing and collecting on the landing on exterior surfaces of the polishing apparatus 10. These materials might otherwise form dried deposits which can flake off and land on the polishing pad 54 causing a defect in the substrate. The splashed liquids may also penetrate the interior workings of the polishing apparatus 10, causing corrosion and other damage. When cleaning is completed, the arm assembly 60 may be raised to allow the contained liquid and residual materials to be centrifugally expelled from the polishing pad 54 as the pad rotates. Expelling the water, diluted slurry, residues and contaminants from the arm assembly 60 prevents the substrate from being polished with diluted slurry.

Figure 5:
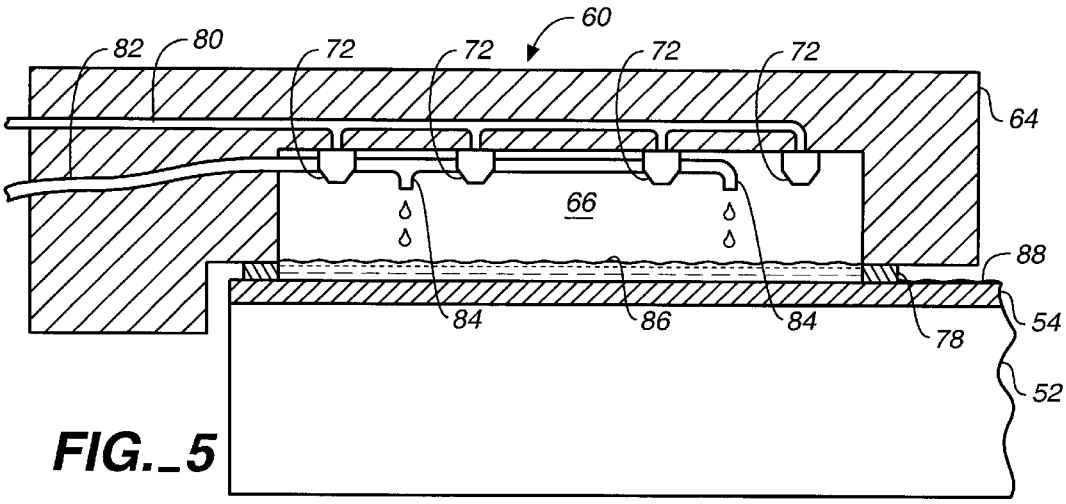
FIG. 5 is a cross-sectional view of the cleaning and slurry distribution assembly being used to distribute slurry on the polishing pad.

The arm assembly 60 is also be used to distribute a polishing slurry to the polishing pad 54. A slurry delivery line 82 may connect one or more slurry outlets 84 to a slurry source for the polishing slurry. As shown in FIG. 5, after the pad has been cleaned, assembly 60 is lowered so that the retainer 78 contacts the polishing pad 54. Then the polishing slurry is fed from the slurry delivery line 82 through the slurry outlets 84 so that it accumulates in a reservoir 86 contained by the retainer 78 and the housing 64. The polishing slurry in the reservoir then either seeps out between a thin gap between the retainer 78 and the polishing pad 54, or is carried beneath the lower retainer 78 by grooves or perforations in the polishing pad 54. In either case, this arm assembly 60 leaves a thin layer of slurry 88 on the polishing pad 54. The assembly housing 64 also prevents the polishing slurry from splattering and coating the exterior surfaces or penetrating the interior surfaces of the polishing apparatus 10.

Figure 6:
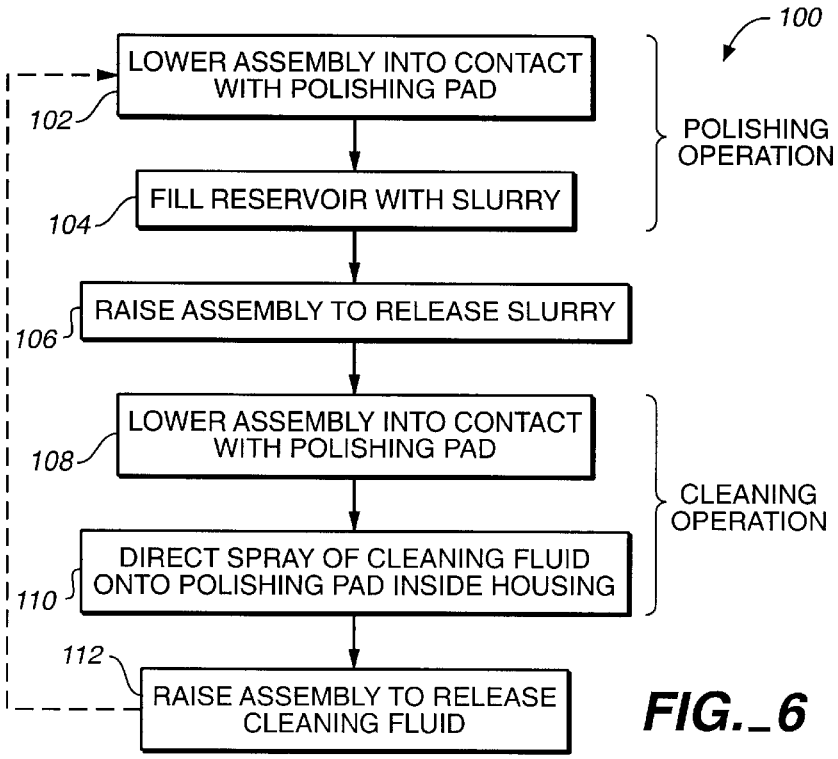
FIG. 6 is a flow chart showing the process performed with the cleaning and slurry distribution assembly.

Referring to FIG. 6, a method 100 performed with the arm assembly 60 begins with a polishing operation when the assembly 60 is lowered into contact with the polishing pad 54 (step 102). The polishing slurry is directed through the slurry delivery line 82 to create the reservoir 86 of slurry on the polishing pad inside the housing 64 (step 104). The polishing proceeds for a period of time, such as about 15 seconds to 2 minutes, during which the reservoir 86 can be periodically or intermittently refilled. Specifically, slurry can be supplied at a flow rate equal to or slightly greater than the consumption rate of the slurry for a given set of polishing parameters. For example, slurry may be dispensed through the slurry outlets 84 at a flow rate in the range of about 50 to 200 ml/min. A well-distributed and uniform thin layer of slurry is deposited the pad 54 by the wiping action of the retainer 78. By depositing a thin layer of slurry, excessive slurry usage can be greatly reduced.

After polishing has been completed, the arm assembly 60 is lifted and the remaining slurry is centrifugally expelled (step 106). During the cleaning operation, the arm assembly 60 is lowered back into contact with the polishing pad (step 108). Then the cleaning fluid (e.g., deionized water) is forced through the nozzles to direct a spray of cleaning fluid onto the polishing pad 54 inside the housing 64 (step 110). The cleaning fluid may be sprayed at a rate of about 0.5 gal./min. The arm assembly 60 may be held in a horizontal position, or it may be swept horizontally across a portion of the polishing pad 54 adjacent the region conditioned by the conditioner head 32. In the later application, the assembly 60 may pivot over a fixed area above the polishing pad 54. If the fixed area does not overlap the area swept by the conditioner arm 32 and head 30, there is no need for a process controller to control the movements of the assembly 60, the carrier head 20, and the pad conditioner 56. The cleaning mode is run for a period of time sufficient to suitably clean the pad in preparation for polishing a substrate, e.g., ten seconds. Once the cleaning operation is completed, the arm assembly 60 is lifted away from the polishing pad so that the waste water inside the housing 64 can be centrifugally expelled from the rotating polishing pad 54 (step 112). It is important for such fluids and materials to be removed from the pad to ensure that the pad is free of contaminants prior to polishing a substrate.

Figure 7:
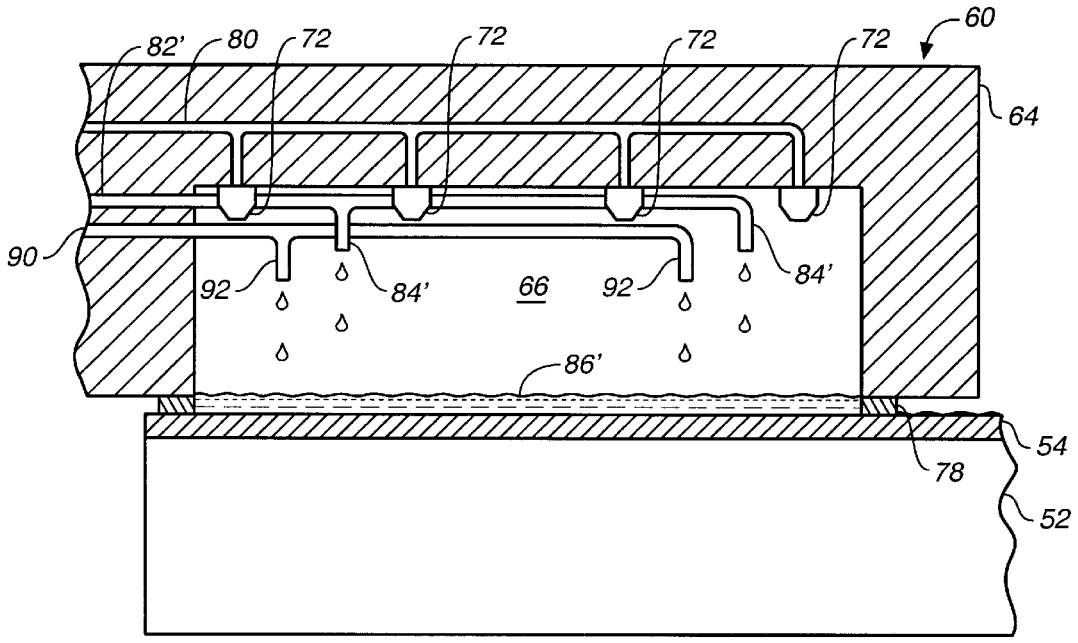
FIG. 7 is a cross-sectional view of a cleaning and slurry distribution assembly that includes multiple slurry delivery lines.

FIG. 7 shows another embodiment of the slurry delivery/rinse arm assembly that includes dual slurry delivery lines. The first slurry delivery line 82' delivers a first slurry component to the polishing pad 54 via one or more of the slurry outlets 84'. A second slurry delivery line 90 delivers a second slurry component to the polishing pad via one or more outlets 92. The first and second slurry components are mixed together in the reservoir formed by the retainer 78. Both slurry delivery lines could deliver abrasive solutions. Alternately, the second slurry delivery line could be used to supply a chemical to control the polishing process, such as a corrosion inhibitor, an oxidizer, a dilution fluid, a pH adjustor, or a surface wetting agent.

For example, in CMP applications to polish a tungsten film layer, the first slurry component may include a solution of ferric nitrate and additives, such as buffers. The second slurry component may include an abrasive solution, such as fumed or colloidal silica, or alumina. Chemical reactions take place between constituents of the first and second slurry components that may age the resultant mixture. Thus, the first and second slurry components are mixed just prior to being utilized as a polishing medium to polish the tungsten.

The lower surface of retainer 78 can be roughened, or an abrasive material can be coated on the lower surface of the retainer 78. When the arm assembly 60 is lowered into contact with the polishing pad 54, the abrasive lower surface of the retainer 78 roughens and deglazes the polishing pad. Thus, the arm assembly 60 can be used to condition the polishing pad. In this implementation, the polishing apparatus 10 need not include a separate pad conditioner 56.

The invention has been described with reference to various drawings, aspects and preferred embodiments. It is to be understood that the above descriptions are made by way of illustration, and that the invention may take other forms within the spirit of the structures and methods described herein. The invention includes variations and modifications thereof as defined in the claims attached hereto.

What is claimed is:

1. An apparatus for use in a chemical mechanical polishing system, comprising:

a housing positionable over a polishing surface and movable in a direction normal to the polishing surface, wherein a part of the housing that covers the nozzle contacts the polishing surface to enclose the polishing surface beneath the nozzle; and at least one nozzle covered by the housing to spray a cleaning fluid against the polishing surface.

2. The apparatus of claim 1, wherein the cleaning fluid is deionized water.

3. The apparatus of claim 1, wherein the housing is configured to be raised and lowered over a region of the polishing surface.

4. The apparatus of claim 1, wherein the at least one nozzle is adapted to spray the cleaning fluid under hydraulic pressure.

5. The apparatus of claim 1, wherein the housing extends toward the center of the polishing surface.

6. The apparatus of claim 1, further comprising a retainer joined to a lower surface of the housing.

7. An apparatus for use in a chemical mechanical polishing system, comprising:

a housing positionable over a polishing surface;

at least one nozzle covered by the housing to spray a cleaning fluid against the polishing surface; and a retainer joined to a lower surface of the housing, wherein the retainer contacts a surface of the polishing surface.

8. The apparatus of claim 7 wherein the retainer contacts the polishing surface at a pressure less than about 5 psi.

9. The apparatus of claim 1, further including a first feed line to supply the cleaning fluid to the assembly.

10. The apparatus of claim 9, wherein the assembly further including a second feed line to supply an aqueous solution of deionized water and an agent selected from the group consisting of a corrosion inhibitor, an oxidize, a cleaner, a pH adjustor, a dilution fluid, and a surface wetting agent.

11. An apparatus for use in a chemical mechanical polishing system, comprising:

a housing assembly positionable over a polishing surface, wherein the assembly includes a first feed line to supply a cleaning fluid, a second feed line to supply an aqueous solution of deionized water and an agent selected from the group consisting of a corrosion inhibitor, an oxidize, a cleaner, a pH adjustor, a dilution fluid, and a surface wetting agent, and a third feed line to supply an abrasive solution; and at least one nozzle covered by the housing to spray the cleaning fluid against the polishing surface.

12. The apparatus of claim 1, wherein the housing is arranged to substantially contain the cleaning fluid, residual polishing slurry, contaminants and fluid, and wherein a lower surface of the housing spreads the polishing slurry over the polishing surface.

13. The apparatus of claim 1, wherein the housing further comprises:

a retainer having a lower surface in close proximity to the polishing surface and enclosing a region; and an outlet to distribute slurry to the enclosed region to form a reservoir of slurry in the enclosed region, wherein the slurry is distributed to a region not enclosed by the retainer by traveling between the polishing surface and the lower surface of the retainer.

14. The apparatus of claim 1, wherein the cleaning fluid is centrifugally removed from the polishing surface.

15. A method of cleaning the surface of a polishing pad in a chemical mechanical polishing system, comprising:

lowering a housing of a cleaning assembly into close proximity of a polishing surface;

directing a cleaning fluid from the cleaning assembly against the polishing surface that has residual contaminants;

substantially containing the cleaning fluid within the housing of the cleaning assembly; and raising the housing away from the polishing surface to expel the cleaning fluid and residual contaminants from the polishing pad.

16. The method of claim 15, wherein the cleaning fluid is deionized water and droplets of the cleaning fluid are produced by subjecting the deionized water to a hydraulic pressure.

17. The method of claim 16, wherein the hydraulic pressure is less than about 60 psi.

18. The method of claim 17, wherein the deionized water droplets are further subjected to an air pressure less than about 10 psi.

* * * * *